US006143168A

United States Patent [19]

Shackelford

[11] Patent Number: 6,143,168

[45] Date of Patent: Nov. 7, 2000

[54] GRATE FOR A SUBSURFACE CATCH BASIN

[75] Inventor: George Shackelford, Riverside, Calif.

[73] Assignee: Normandy Products Company, Verona, Pa.

[21] Appl. No.: 09/359,877

[22] Filed: Jul. 27, 1999

[51] Int. Cl.[7] ..... B01D 29/03; B01D 35/02

[52] U.S. Cl. ..... 210/164; 210/474; 210/498; 404/4

[58] Field of Search ..... 210/163, 164, 210/166, 474, 477, 498; 404/2, 4

[56] References Cited

U.S. PATENT DOCUMENTS

| | | | |
|---|---|---|---|
| 3,713,539 | 1/1973 | Thompson et al. | 210/164 |
| 4,261,824 | 4/1981 | Cuschera | 210/164 |
| 4,345,998 | 8/1982 | Graffis et al. | 210/164 |
| 4,367,142 | 1/1983 | Blecher | 210/163 |
| 5,130,016 | 7/1992 | Gavin | 404/4 |
| 5,486,287 | 1/1996 | Murphy et al. | 210/164 |
| 5,529,431 | 6/1996 | Walsh | 210/164 |

*Primary Examiner*—Christopher Upton
*Attorney, Agent, or Firm*—Donald D. Mon

[57] ABSTRACT

A grating for a catch basin is disclosed. The grating is formed as a hollow monolithic body from plastic, having a top bearing plate, a peripheral rim, a peripheral bearing shoulder extending inwardly from the rim forming an internal recess, a peripheral downwardly extending skirt, a peripheral base extending inwardly from the skirt, and a peripheral inner wall extending upwardly from the base to the top plate. The top bearing plate has a plurality of slits formed by spaced apart hollow bars. An integral hollow rib in the form of a cross beam extends beneath the top plate. A metal reinforcing plate may be positioned in the cross beam.

9 Claims, 3 Drawing Sheets

GRATE FOR A SUBSURFACE CATCH BASIN

SPECIFICATION

1. Field of the Invention

A grate principally made from an organic plastic material and formed as a hollow monolithic body by a rotational molding process to rest on the top of a catch basin, there to resist bearing loads and to screen trash from a water stream that flows into the catch basin.

2. Background of the Intention

Grates to cover the open top of subsurface catch basins are required to support substantial bearing loads from persons, equipment and vehicles that stand on them or roll over them. These loads can be as large as several thousand pounds resting or rolling over an 18 inch or larger grate. Accordingly such grates are customarily made from very strong materials, usually metal. Occasionally one will encounter a reinforced structure such as concrete reinforced with metal rods or the like. These prior art products have in common their heavy weight to be lifted and carried, and the need for a very strong support beneath them to support their weight.

Modern organic plastics such as polypropylene have ideal properties for grates of this type. Low specific weight, strength of material, resistance to abrasion, and oxidation are a few. However, inherent properties are not enough to produce an optimum product. The cost of production, and the ultimate weight of the product when produced, the cost of tooling and production to make it, and the capacity to resist heavy loads are among other deciding factors.

Prior to this invention, the inherent advantages of organic plastic materials were not practically available to the manufacturer. It is an object of this invention to provide such a product, which is enabled by its being manufactured with a rotational molding process.

BRIEF DESCRIPTION OF THE INVENTION

A grate according to this invention is manufactured with the use of a rotational molding process. In this process a closed mold is rotated while it contains a precise quantity of plastic to be cured. Only the outside surface of the grate is formed by the mold. Appropriate manipulation of the closed mold distributes the material over the inside surface of the mold to form a wall of surprisingly uniform thickness. This process requires no internal mold part. The outside of the metal mold is heated to cure the plastic while the mold is rotated. After the material is cured, the mold is opened and the part is removed.

A grate according to this invention is a closed, monolithic hollow body having a top bearing plate, a peripheral rim, a peripheral bearing shoulder extending inwardly from the rim forming an internal recess, a peripheral downwardly extending skirt, a peripheral base extending inwardly from said skirt, and a peripheral inner wall extending upwardly from said base to said top bearing plate.

The bearing plate is a slotted body having a plurality of parallel slits therethrough formed by spaced apart hollow bars.

An integral hollow rib extends across the grate beneath the bearing plate. According to a preferred but optional feature, a reinforcing plate has a pair of flanges which fit in said recess at each of two sides. It is anchored in these recesses. The resulting structure, even without the plate, is self-reinforcing and very stiff. It resists heavy bearing loads, including those which are not evenly distributed over the surface, such as rolling loads.

This invention will be fully understood from the following detailed description and the accompanying drawings, in which:

DETAILED DESCRIPTION OF THE INVENTION

Figure 4:
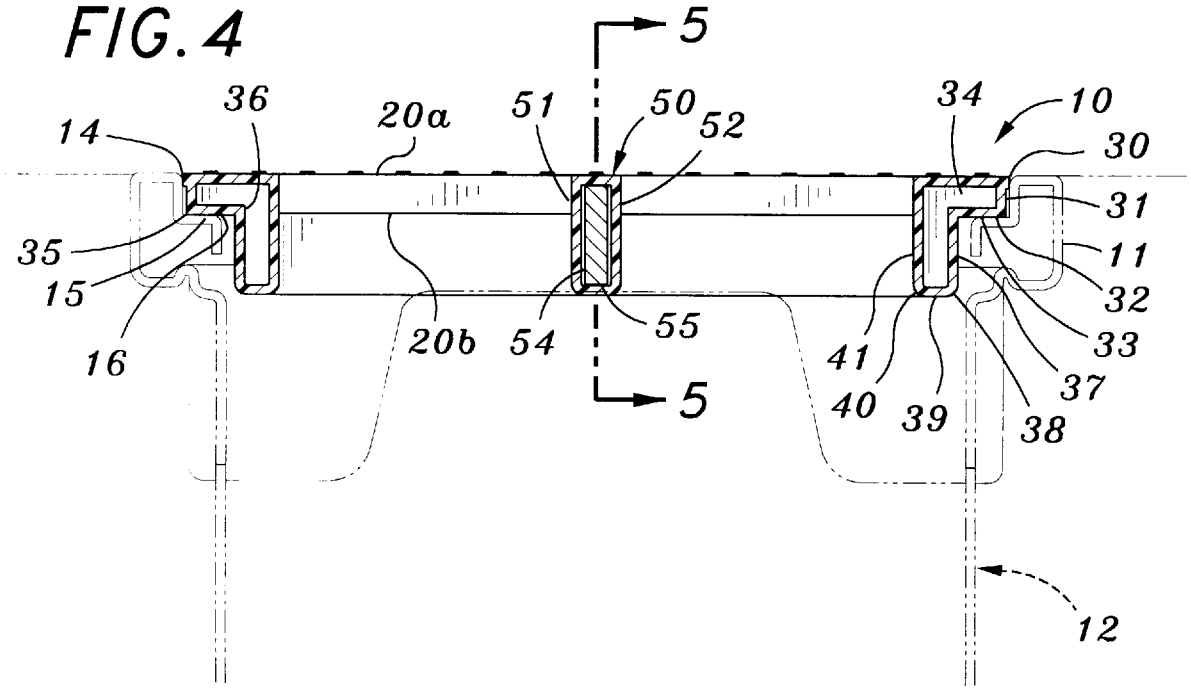
FIG. 4 is a cross-section taken at line 4—4 in FIG. 3.

A grate 10 according to the invention is intended to rest on rim 11 of a catch basin 12, the upper portion 13 of which is schematically shown in FIG. 4. The details of the basin are no limitation on this invention. Of importance, however, are a socket 14, a seat 15, and a downwardly extending peripheral boundary 16 that form an opening to receive a section of the grate.

The basin is preferably square, so that a central cross-section and a side view of each side will be identical to one another.

Figure 6:
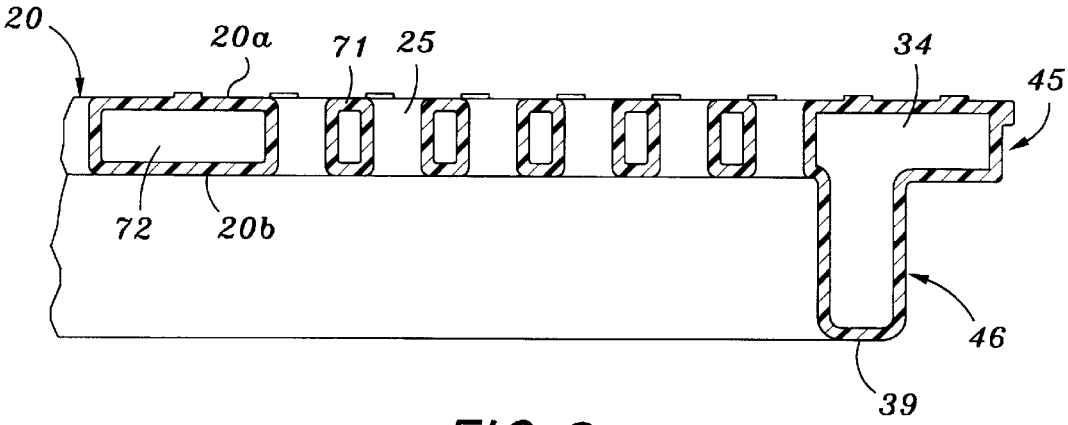
FIG. 6 is a fragmentary cross-section taken at line 6—6 in FIG. 1.

The grate includes a square top bearing plate 20 (FIG. 1) with a top surface plate 20*a*, a bottom surface 20*b* (FIGS. 4 and 6), and with four sides 21, 22, 23, 24. Four sets 25, 26, 27, 28 of slots pass through the top plate in a way which will be further disclosed below.

At this point the reader is reminded that the structure to be described is hollow and monolithic. It is formed only by the inside surfaces of a rotational mold. Completion of hollow structures is attained by abutting mold parts, which shape only the outside surface. The inside surfaces of the molded product are geometrically similar to the inside wall of the mold, differing only in dimensions because of the thickness of the cured wall. There are no inside surfaces of the product which are formed by an outside wall of a mold, because there can be none.

Because the four sides of grate are identical, only sides 22 and 24 will be described in detail.

Top surface plate 20*a* has a peripheral edge 30 from which a peripheral rim 31 depends. From its lower edge 32, a bearing shoulder 33 extends inwardly, spaced from the top surface plate so as to form a recess 34 and a downwardly bearing surface 35.

At the inside edge 36 of the bearing shoulder, a skirt 37 extends downwardly to its lower edge 38. A peripheral base 39 extends inwardly to its own inner edge 40. A peripheral return surface 41 extends upwardly from edge 40 to join with the lower plate 20*b* of top bearing plate.

It will now be observed that this closed structure forms a hollow inverted L shaped section with an internal cavity 34, external bearing flange 45, and an external depending section 46. Bearing flange 45 rests on seat 15 of the catch basin. The periphery of the top plate and of the depending section are centered in the top opening of the catch basin.

Figure 5:
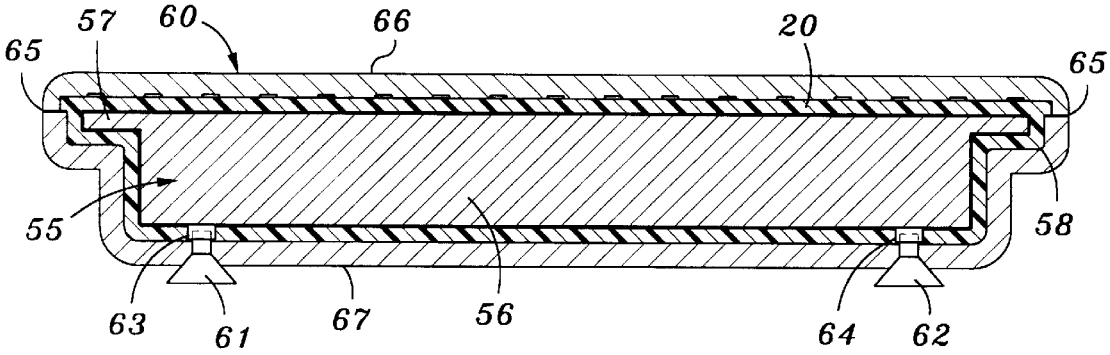
FIG. 5 is a cross-section taken at line 5—5 in FIG. 4.

Although the structure thus far disclosed strongly resists crushing and twisting forces, this grate is further strengthened by a cross-beam 50 which extends between edges 21 and 23. It is formed integrally with the remainder of the grate, and in the same process and mold. As shown in FIGS. 4 and 5 it has sidewalls 51, 52 that depend from the top plate, and a base 53 which joins them. This forms a beam cavity 54 in the cross-beam.

A reinforcing plate 55 is located in cavity 54, extending across the grate. It has a central flat section 56 and a pair of flanges 57, 58. As can be seen in FIG. 5, the flanges fit in recesses 34.

In order to place this plate in the correct position in the product, it is held to one part of a two part mold 60 by screws 61, 62 threaded into nuts 63, 64 that are fixed to the plate. After the grate is formed, the screws are taken out so the mold parts can be separated at parting line 65 and removed. The mold has two parts 66, 67 which join one another to form the closed mold structure.

The reinforcing plate is supported on shoulders 28. All edges of the plate are preferably contacted by plastic material. However, its flat faces need not be adhered to by the plastic, although they may be. The function of this plate is to resist buckling and twisting under load, which does not require that it be adhesively encapsulated. In fact, some clearances, total or partial between it and the plastic material are tolerable. However its flanges 57, 58 are preferably trapped by the plastic.

The top plate is pierced by slots 25–28. These slots are formed by and between hollow bars 71 whose outside surfaces are formed by inside surfaces of the mold. All of the bars are identical.

Figure 1:
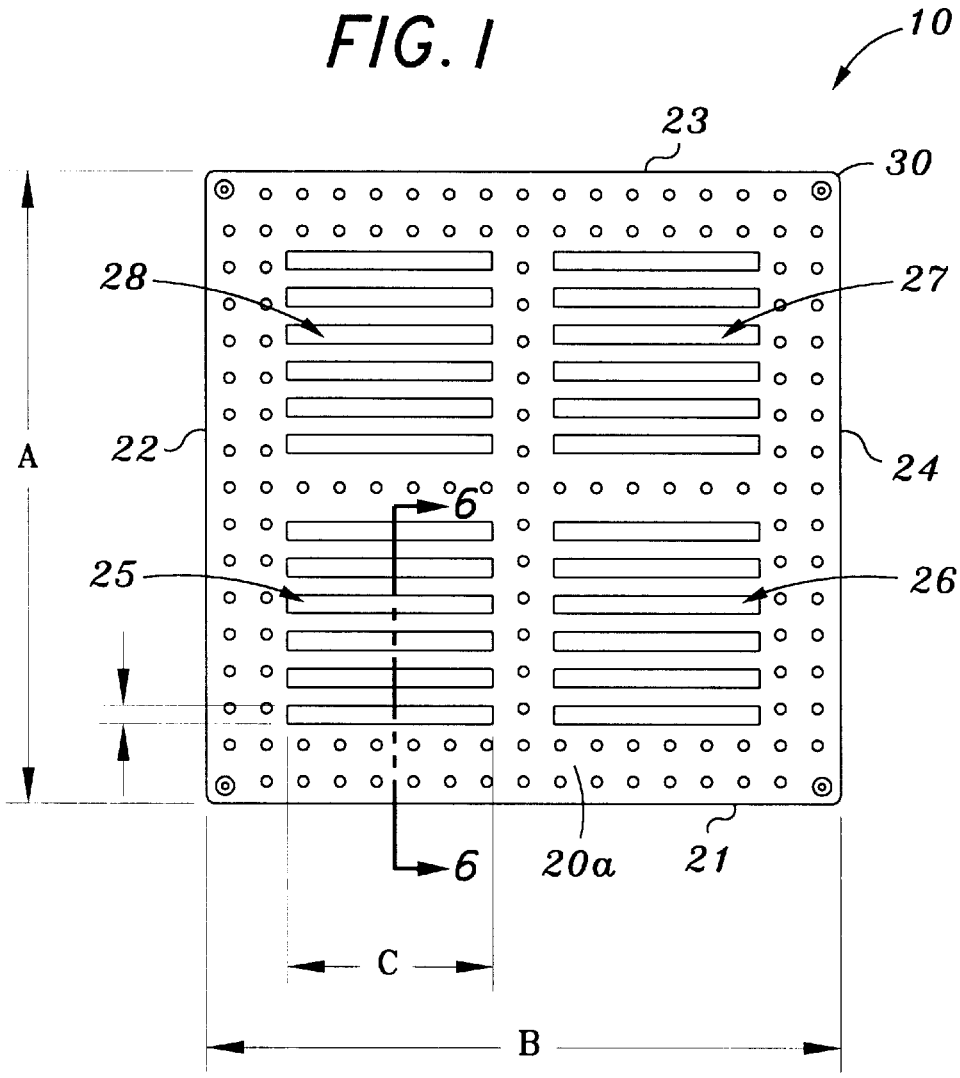
FIG. 1 is a plan view of the top of the presently-preferred embodiment of the invention.
Figure 2:
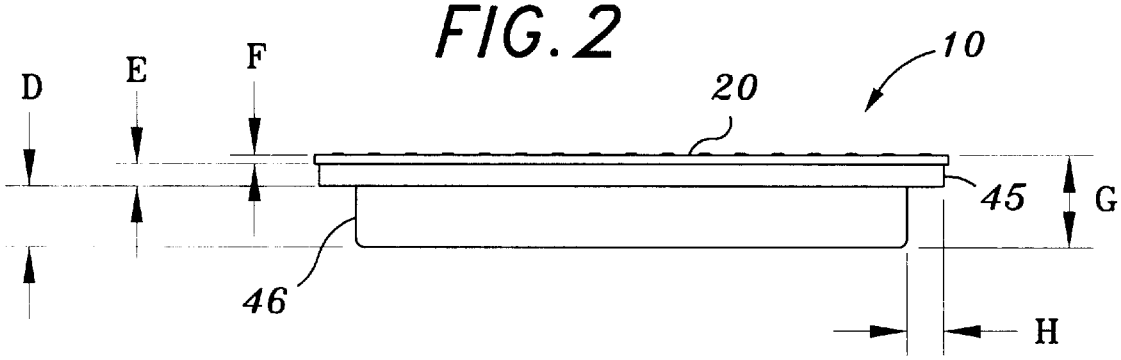
FIG. 2 is a side view of FIG. 1, taken at the bottom thereof, the views of all four sides being identical.
Figure 3:
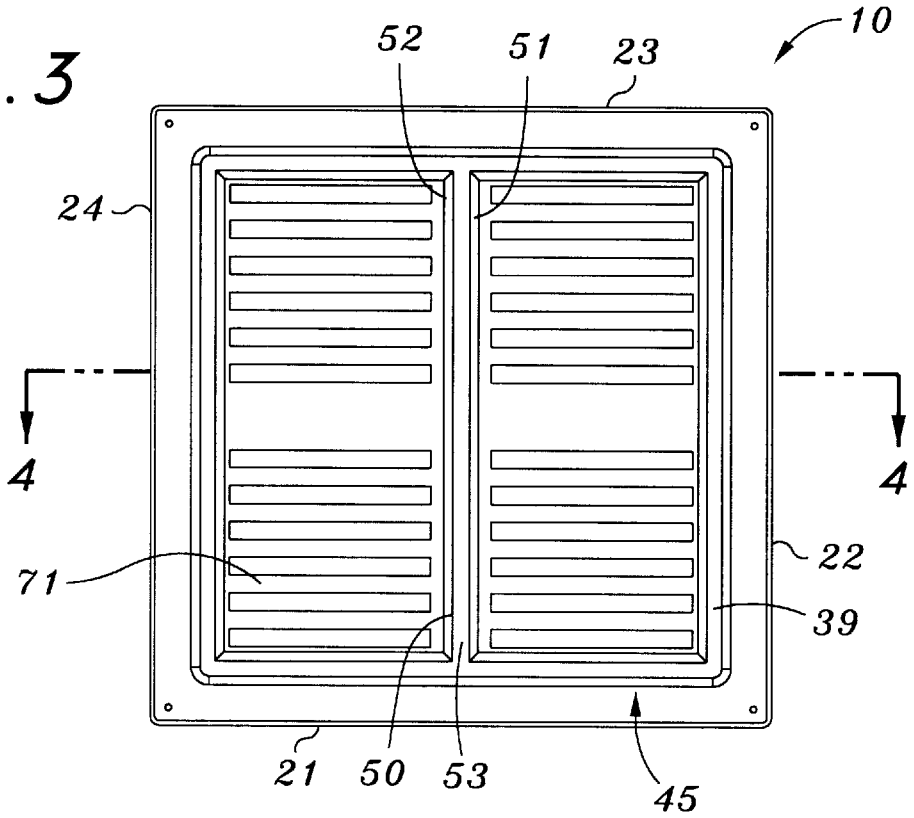
FIG. 3 is a plan view of the bottom of the grate shown in FIG. 1.

As shown in FIG. 1 the bars are shorter than the width of the top plate. Their area is reduced by interposing the cross beam and a stiffening channel 72 normal to it. These intersect one another. The shortened bars are better able to resist bending because of their shorter length. The bars are formed by the joinder of the top and bottom plates of the top bearing plate at appropriate locations.

This invention provides a grate principally made of an organic plastic, optionally reinforced by a rib and a metal plate in the rib. It can be manufactured economically by the rotational molding process and can withstand heavy loads. Dimensions suitable for an 18 inch by 18 inch grate are as follows, with reference to the drawings. The dimensions are in inches.

| | |
|---|---|
| A - 17.25 | E - 0.60 |
| B - 17.25 | F - 0.25 |
| C - 5.60 | G - 2.52 |
| D - 1.67 | H - 1.50 |

The plastic material is polypropylene. The wall thickness is on the order of about 0.200 inches. The material of the reinforcing plate is preferably ¼ inch thick HRS flat bar.

This grate reliably supports a weight of 4,000 pounds when rested on a catch basin as shown in FIG. 4.

This invention is not to be limited by the embodiment shown in the drawings and described in the description, which is given by way of example and not of limitation, but only in accordance with the scope of the appended claims.

What is claimed is:

1. A grate to cover the open top of a catch basin, said grate comprising a hollow, continuous, integral and monolithic body of organic plastic material which has been formed by a rotational molding process, said body comprising:

a top bearing plate, said top bearing plate having a plurality of spaced apart slots therethrough, said slots being bounded by bars which are an integral part of the top bearing plate, said top plate and grate being generally square-shaped, having four bounding sides, said top bearing plate having a peripheral edge;

a peripheral rim having an upper and a lower edge, its upper edge joining the lower edge of the top bearing plate;

a bearing shoulder having an inner and an outer edge extending around all sides of the grate, said top bearing plate, rim and bearing shoulder forming an internal recess, a bearing surface being formed on the bottom of said bearing shoulder, whereby to form an external bearing flange;

a skirt having an upper and a lower edge, its upper edge joining the inner edge of said bearing shoulder;

a peripheral base having an inner edge and an outer edge, its outer edge joining the bottom edge of said skirt;

a peripheral return surface having a lower edge extending upwardly from the inner edge of said peripheral base to join said top bearing plate; and a cross-beam extending between a pair of said sides, said cross beam having a pair of spaced-apart sidewalls depending from said top bearing plate, each having a lower edge, and a central section joining said bottom edge, thereby forming a beam cavity.

2. A grate according to claim 1 in which a metal reinforcing plate is disposed in said beam cavity, said plate having a substantial flat central area, and a pair of oppositely directed flanges, said flanges extending into internal recesses.

3. A grate according to claim 2 in which said flanges are closely confined in said beam cavity by material forming the cross-beam.

4. A grate according to claim 2 in which said flanges are restrained in said internal recesses by said plastic material.

5. A grate according to claim 2 in which said flanges are closely confined in said beam cavity by material forming the cross-beam.

6. A grate according to claim 2 in which said slots are provided in spaced apart groups which are spaced from said cross-beam.

7. A grate according to claim 1 in which said bars are hollow.

8. A grate according to claim 7 in which a metal reinforcing plate is disposed in said beam cavity, said plate having a substantial flat central area, and a pair of oppositely directed flanges, said flanges extending into internal recesses.

9. A grate according to claim 1 in which said slots are provided in spaced apart groups.

* * * * *